US006981624B2

(12) United States Patent
Link et al.

(10) Patent No.: US 6,981,624 B2
(45) Date of Patent: Jan. 3, 2006

(54) AMMUNITION CARRIER SYSTEM

(75) Inventors: Donald J. Link, Shakopee, MN (US); Joel J. Hafermann, Shakopee, MN (US)

(73) Assignee: Skirts Plus Corporation, Savage, MN (US)

( * ) Notice: Subject to any disclaimer, the term of this patent is extended or adjusted under 35 U.S.C. 154(b) by 10 days.

(21) Appl. No.: 10/624,934

(22) Filed: Jul. 22, 2003

(65) Prior Publication Data

US 2005/0017043 A1 Jan. 27, 2005

(51) Int. Cl.
*A45C 1/04* (2006.01)

(52) U.S. Cl. ..... 224/674; 224/257; 224/249; 220/23.4; 206/315.11; 206/37

(58) Field of Classification Search ..... 224/674, 224/257; 206/420, 69, 433, 150, 151, 153; 220/23.4; 248/312.1
See application file for complete search history.

(56) References Cited

U.S. PATENT DOCUMENTS 2,548,080 A 4/1951 Thorn
2,754,962 A * 7/1956 Scrymgeour ..... 206/162
3,115,287 A 10/1963 McGrew
3,819,095 A 6/1974 Snyder
4,049,165 A 9/1977 Goldhaft
4,323,181 A 4/1982 Spasoff
4,383,385 A 5/1983 Myers
4,960,219 A * 10/1990 Jordan et al. ..... 215/354
5,005,721 A 4/1991 Jordan
5,071,001 A 12/1991 Ryman, III
5,425,196 A 6/1995 Schwarze
5,501,322 A * 3/1996 Drebushenko ..... 206/151
5,720,406 A 2/1998 Fassbind et al.
5,761,845 A 6/1998 Bartholomew
6,106,783 A * 8/2000 Gamble ..... 422/102
6,533,151 B1 * 3/2003 Link ..... 224/251

* cited by examiner

*Primary Examiner*—Tri Mai
(74) *Attorney, Agent, or Firm*—Altera Law Group, LLC

(57) ABSTRACT

Disclosed herein is a user mountable ammunition carrier system for conveniently storing and carrying hunting and shooting accessories by a hunter while navigating dense brush and foliage. The ammunition carrier system includes a body member having a plurality of openings for receiving a plurality of container tubes. The elastomeric body member is also adapted to directly receive and frictionally retain a plurality of rifle cartridges in the openings. The ammunition carrier system is provided with a length adjustable lanyard secured to an elastomer carrier that supports a number of separate transparent storage tubes that plug-mount to the carrier. The carrier is also adapted to be attached to the belt of a user.

10 Claims, 7 Drawing Sheets

AMMUNITION CARRIER SYSTEM

BACKGROUND OF THE INVENTION

1. Field of the Invention

This invention relates in general to carrier systems, and in particular, to a user mounted or user mountable carrier system for conveniently storing ammunition, shells, powder, primers, projectiles, ear plugs, and various other shooting and hunting accessories.

2. Description of Related Art

A problem encountered by hunters, shooters and other individuals who desire to carry ammunition and accessories is that of conveniently carrying the items. For example, a hunter or shooter may want to carry powder, projectiles, primers, wadding, cartridges, bullets, earplugs, and a variety of other hunting and shooting accessories. The problem is especially troublesome to those who desire to be mobile while hunting and shooting, such as when walking and hiking through brush and dense foliage. Large ammunition boxes can be carried, but the economic risks of losing significant amounts of hunting and shooting equipment can be great with accidental spillage. A more portable carrier assembly is therefore desired.

For most circumstances, only a relatively few items need to be carried.

Although a variety of hinge covered, multi-compartmented, molded plastic containers can be used, the compartments frequently do not accommodate long and/or bulky accessories, such as rifle cartridges, powder charges and projectiles. Roll-up fabric containers and commercially available threaded, stackable, tubular storage containers also experience the same problem. The foregoing containers also typically require the hunter or shooter to separately carry the container in an available pocket, backpack or vest.

A variety of user supported, lanyard and clip mounted assemblies have been developed specifically for hunters. These assemblies typically include various arrangements of ammunition, hunting accessories, and shooting supplies. The lanyards are typically worn around the neck. Otherwise, available retainer clips and spring-biased tethers can support the accessories to other items of clothing. Each accessory is thereby made available with relatively little encumbrance to the hunter or shooter.

The foregoing assemblies, however, are neither designed nor adapted to contain cartridges, powder charges, primers, projectiles, hunting accessories, and shooting accessory items. Some relatively small, hinged, covered plastic containers that provide a number of covered compartments that are covered by a common hinged lid are available and may also be mounted to a lanyard. The single hinged lid that covers the storage compartments, however, is susceptible to accidental release and consequently increases the risk of spilling the costly shooting accessories and other contents.

It can be seen that there is a need for user mounted portable carrier system for conveniently storing hunting and shooting accessories or other small items that is light weight and easily carried along by a shooter or hunter while maneuvering through brush and dense foliage.

SUMMARY OF THE INVENTION

To overcome the limitations in the prior art described above, and to overcome other limitations that will become apparent upon reading and understanding the present specification, the present invention discloses a user mounted portable container system for conveniently storing hunting and shooting accessories or other small items that is light weight and easily carried along by a shooter or hunter while navigating through dense brush and foliage.

The present invention solves the above-described problems by providing an ammunition carrier system. The ammunition carrier system of the present invention provides an inexpensive portable storage system for ammunition and shooting accessories that are desirable to a hunter while hunting. The container system is also useful for innumerable other uses where a portable, hands-free carrier system is desirable.

The carrier system may additionally be provided with a length adjustable lanyard or tether, among a variety of retainers, which may be secured to an elastomer carrier that supports a number of separate transparent storage tubes or containers that plug-mount to the carrier. The tubes may contain miscellaneous items and/or hunting and shooting accessories. Openings may be formed in the carrier system designed and configured to support and carry primers, projectiles, cartridges and powder charges and container tubes containing various shooting accessories.

A system in accordance with the principles of the present invention includes an ammunition carrier system including a plurality of container tubes. Each container tube has an open end and a closed end. The carrier system also includes a body member having a plurality of first openings and a ridge member disposed along a portion of the body member. The ridge member is provided with plurality of second openings. The first openings are adapted to receive and frictionally retain the container tubes therein. Each container tube encloses a storage space and a portion of each container tube extends a distance from the body member when secured thereto. The storage space being accessible when the container tube is unsecured from the body member.

Other embodiments of a system in accordance with the principles of the invention may include alternative or optional additional aspects. One such aspect of the present invention is that the container tubes are removably securable to the body member via a frictional attachment between exterior surfaces of the tubes and interior surfaces of the first openings.

Another aspect of the present invention is that the first openings are arranged perpendicular to the second openings.

Another aspect of the present invention is that the first openings have a first diameter, the second openings have a second diameter, and the first diameter is different from the second diameter.

Another aspect of the present invention is that the ridge member extends substantially along a length of the body member.

Another aspect of the present invention is that the second openings are adapted to receive and frictionally retain a shooting accessory therein.

Another aspect of the present invention includes a lanyard for securing the ammunition carrier system to a user, and the lanyard being connectable to an attachment opening disposed in the ridge member.

Another aspect of the present invention is that the body member and the ridge member are molded from a flexible elastomeric material, and wherein the first and second openings are expandable to receive and frictionally retain therein accessories, wherein when the accessories are removed from the first and second openings, the first and second openings return to a pre-expansion dimension.

Another aspect of the present invention is that the container tubes provide watertight storage of accessories stored therein.

Another system in accordance with the principles of the present invention includes an ammunition carrier system including a first body member having a plurality of first openings along a first body member side thereof. The carrier system also includes a second body member having a plurality of second openings along a second body member side thereof. The carrier system also includes an attachment member flexibly attaching the first body member to the second body member at a first location. The carrier system also includes means for connecting the first body member to the second body member at a second location.

Another aspect of the present invention is that the first openings extend into the first body member a small portion of a width of the first body member.

Another aspect of the present invention is that the second openings extend into the second body member a small portion of a width of the second body member.

Another aspect of the present invention is that the first openings extend entirely through a width of the first body member.

Another aspect of the present invention is that the second openings extend entirely through a width of the second body member.

Another aspect of the present invention is that the ammunition carrier system further includes a plurality of third openings along a first body member opposing side. The third openings extend into the first body member a small portion of a width of the first body member.

Another aspect of the present invention is that the ammunition carrier system further includes a plurality of fourth openings along a second body member opposing side. The fourth openings extend into the second body member a small portion of a width of the second body member.

Another aspect of the present invention is that the ammunition carrier system is molded from a flexible elastomeric material, and the first, second, third and fourth openings are adapted to receive and frictionally retain a shooting accessory therein.

Another aspect of the present invention is that the ammunition carrier system is molded from a flexible elastomeric material, and the first, second, third and fourth openings are expandable to receive and frictionally retain accessories therein and when the accessories are removed from the first, second, third and fourth openings, the first, second, third and fourth openings return to a pre-expansion dimension.

Another aspect of the present invention is that the ammunition carrier system is attachable to a belt of a user by placing the first body member on one side of the belt and the second body member on another side of the belt, and wherein the attachment band and the connection means secure the ammunition carrier system to the belt.

Another system in accordance with the principles of the present invention includes an ammunition carrier system including a body member having a plurality of first openings along a body member side thereof. The ammunition carrier system also includes means for connecting the body member to a belt of a user. The ammunition carrier system also includes an attachment member flexibly attaching the body member to the connection means.

Another aspect of the present invention is that the first openings extend entirely through a width of the body member.

Another aspect of the present invention is that the first openings extend into the body member a small portion of a width of the body member.

Another aspect of the present invention is that the ammunition carrier system also includes a plurality of second openings along a body member opposing side. The second openings extend into the body member a small portion of a width of the body member.

Another aspect of the present invention is that the ammunition carrier system is molded from a flexible elastomeric material, and the first openings are expandable to receive and frictionally retain accessories therein and when the accessories are removed from the first openings, the first openings return to a pre-expansion dimension.

Another aspect of the present invention is that the ammunition carrier system is molded from a flexible elastomeric material, and the first and second openings are expandable to receive and frictionally retain accessories therein and when the accessories are removed from the first and second openings, the first and second openings return to a pre-expansion dimension.

Another aspect of the present invention is that the connection means comprises a flexible loop member adapted to receive a belt in a loop opening therethrough.

Another aspect of the present invention is that the attachment member is attached along a substantial length of the body member.

Another aspect of the present invention is that the attachment member is attached along a substantial length of the body member and the loop member.

The foregoing objects, advantages and distinctions of the invention, among others, are obtained in a presently preferred construction that provides an elastomer ammunition carrier system.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of an apparatus in accordance with the invention.

BRIEF DESCRIPTION OF THE DRAWINGS

Referring now to the drawings in which like reference numbers represent corresponding parts throughout.

DETAILED DESCRIPTION OF THE INVENTION

In the following description of the exemplary embodiment, reference is made to the accompanying drawings which form a part hereof, and in which is shown by way of illustration the specific embodiment in which the invention may be practiced. It is to be understood that other embodiments may be utilized as structural changes may be made without departing from the scope of the present invention.

The present invention provides a user mounted or user mountable ammunition carrier system for conveniently carrying cartridges, projectiles, primers, powder charges, wadding, and other hunting and shooting accessories. The ammunition carrier system of the present invention provides an inexpensive portable carrier system for small items that are desirable to a hunter while hunting. The container system is also applicable to innumerable other uses where a portable, hands-free carrier system is desirable.

Figure 1:
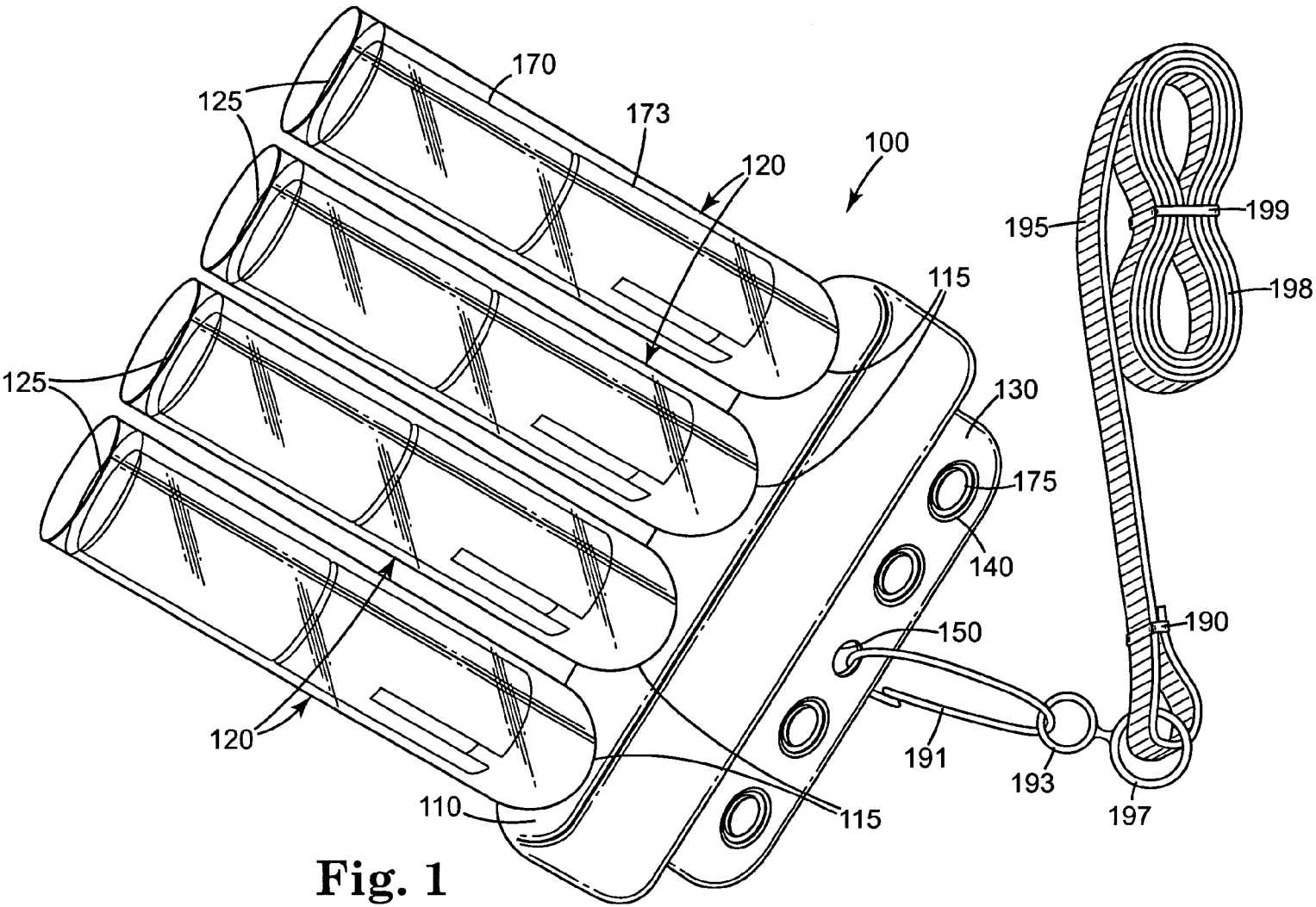
FIG. 1 illustrates a perspective view of an ammunition carrier system having a lanyard attached thereto according to an embodiment of the present invention.

FIG. 1 is a perspective view of an ammunition carrier system 100 having a lanyard attached thereto according to an embodiment of the present invention. In FIG. 1, the ammunition carrier system 100 is shown including a body member 110. The body member 110 is provided with a plurality of tube receiving openings 115 along a portion thereof and a ridge member 130 provided with a plurality of primer receiving openings 140. The ridge member 130 is provided with a central attachment opening. Each of the primer receiving openings 140 is shown having a primer 175 disposed therein. Each of the tube receiving openings is shown having a container tube 120 disposed therein. The container tubes have a bottom 125 forming an enclosed space within the container tubes 120 where a powder charge 170 and a composite projectile member and wadding 173 are retained in a watertight enclosure. The container tubes 120 also have an open end (not shown) disposed inside the tube receiving openings 115.

The central attachment opening 150 of the ridge member 130 is shown having a clip 191 connected through the hole 150. The clip 191 is connected to a swivel 197 through ring 193. The swivel 197 is connected to a lanyard 195. The lanyard 195 is adjustable in length through cinch bead 190. The lanyard 195 is shown rolled into a bundle 198 and banded with a band 199 in the FIG. 1, however in use, the lanyard 195 may be worn around the neck of a hunter or shooter or tied to the wrist or some other part of the hunter's body or clothing to secure and mount the ammunition carrier system 100 thereto.

The body member 110 is molded from a resilient, flexible elastomeric material, such as natural rubber, latex rubber or silicone rubber. Such materials are durable and readily accept a variety of pigments, camouflage, and other surface ornamentation to accentuate consumer appeal. These materials accommodate the normally intended outdoor environment and also allow the tube receiving openings 115 and primer receiving openings 140 to stretch and compress over the tubes 120 and primers 175 during mounting into the body member 110 and ridge member 130 forming a frictional engagement therewith, respectively. The size of the body member 110 and container tubes 120 can be varied as desired.

The container tubes 120 are transparent cylindrical tubes that are open at one end and sealed closed at the other end. The tubes 120 are configured to be frictionally retained in the openings 115 formed in the body member 110. The tubes 120 are designed and configured to be securely and frictionally engaged to the body member 110 either through exterior engagement. In FIG. 1, the tubes 120 are shown engaged via exterior engagement to the body member 110 via frictional engagement between the exterior surface of the tubes 120 and the interior surface of the tube receiving openings 115. The container tubes 120 may be of a variety of different sizes and shapes provided that the tubes can be inserted and frictionally secured to the body member 110.

The container tubes 120 may be used to store and contain powder charges, wadding, projectiles, complete rifle cartridges, ear plugs, and various other paraphernalia used by hunters and shooters. The container tubes 120 may be formed of plastic, glass or other watertight transparent materials. Because the container tubes 120 are formed of a transparent material, the contents are readily visible to the user and are easily accessible upon withdrawing the container tubes 120 from the tube receiving openings 115. The diameter and depth of the tube receiving openings 115 are sized to assure that the container tubes 120 are held fast under normal conditions. Because the body member 110 is molded from a flexible elastomeric material, a frictional fit is obtained to each container tube 120.

Figure 2:
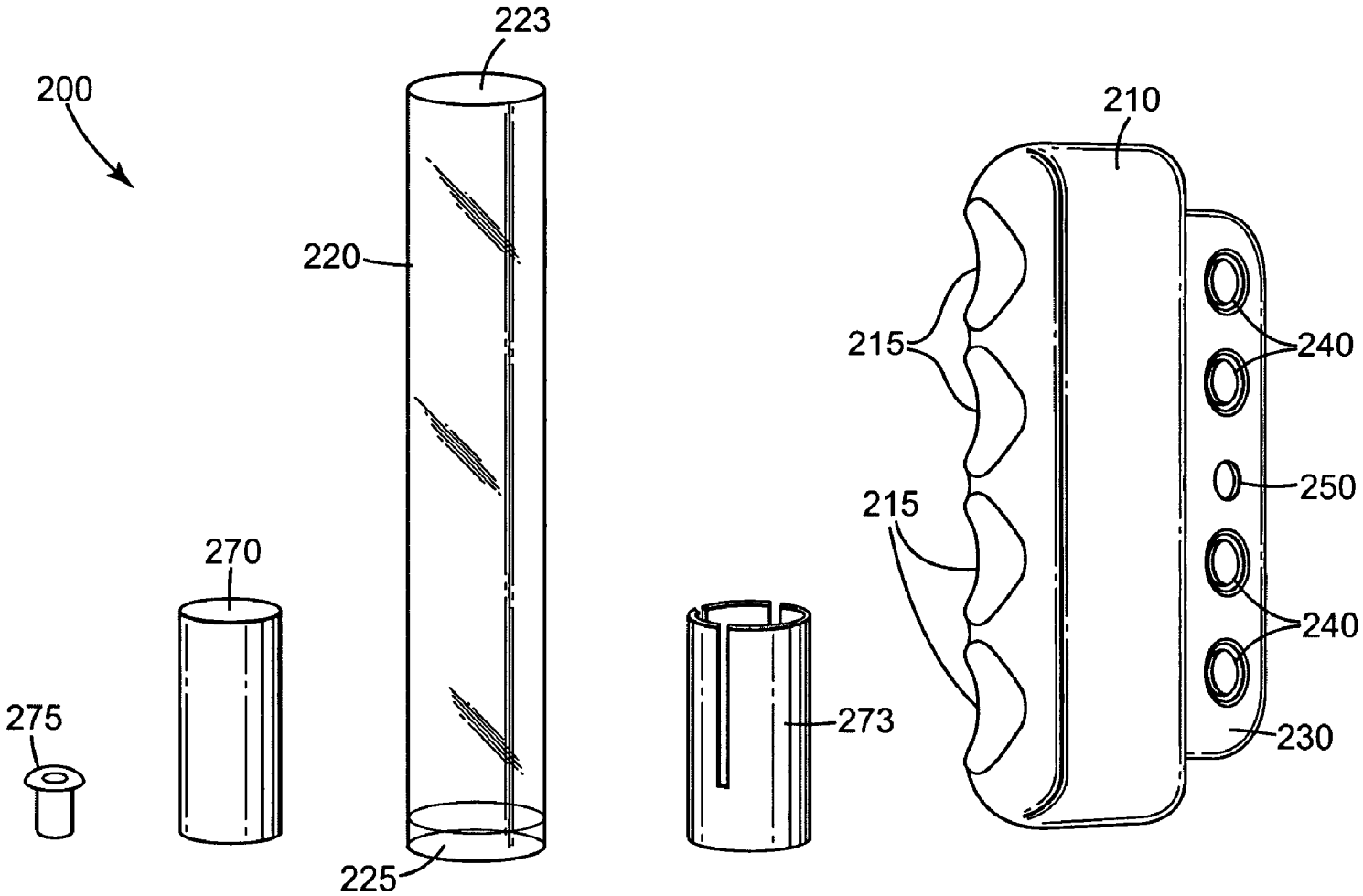
FIG. 2 illustrates a disassembled view of an ammunition carrier system having a container tube removed from the tube receiving orifice and contents of the container tube removed therefrom according to an embodiment of the present invention.

FIG. 2 is a disassembled view of an ammunition carrier system 200 having a container tube 220 removed from the tube receiving orifice 215 and contents of the container tube 220 removed therefrom according to an embodiment of the present invention. In FIG. 2, the body member 210 is provided with a plurality of tube receiving openings 215 and the ridge member 230 is provided with a central attachment opening 250 and a plurality of primer receiving openings 240. The container tube 220 is provided with an open end 223 for receiving shooting accessories and a closed end 225. Some exemplary shooting accessories have been removed from a container tube 220 and are also shown in the FIG. 2. Primer receiving opening 240 is adapted to receive primer 275 frictionally therein. The container tube 220 is adapted to receive powder charge 270 and a combination projectile and wadding arrangement 273 therein. The shooting accessories are shown for example purposes and the invention is not limited to storing only those exemplary shooting accessories disclosed. The container tube 220 being formed of a transparent material allows the contents stored in the container tube 220 to be readily viewable by the hunter or shooter without removing the container tube 220 from the body member 210.

Figure 3:
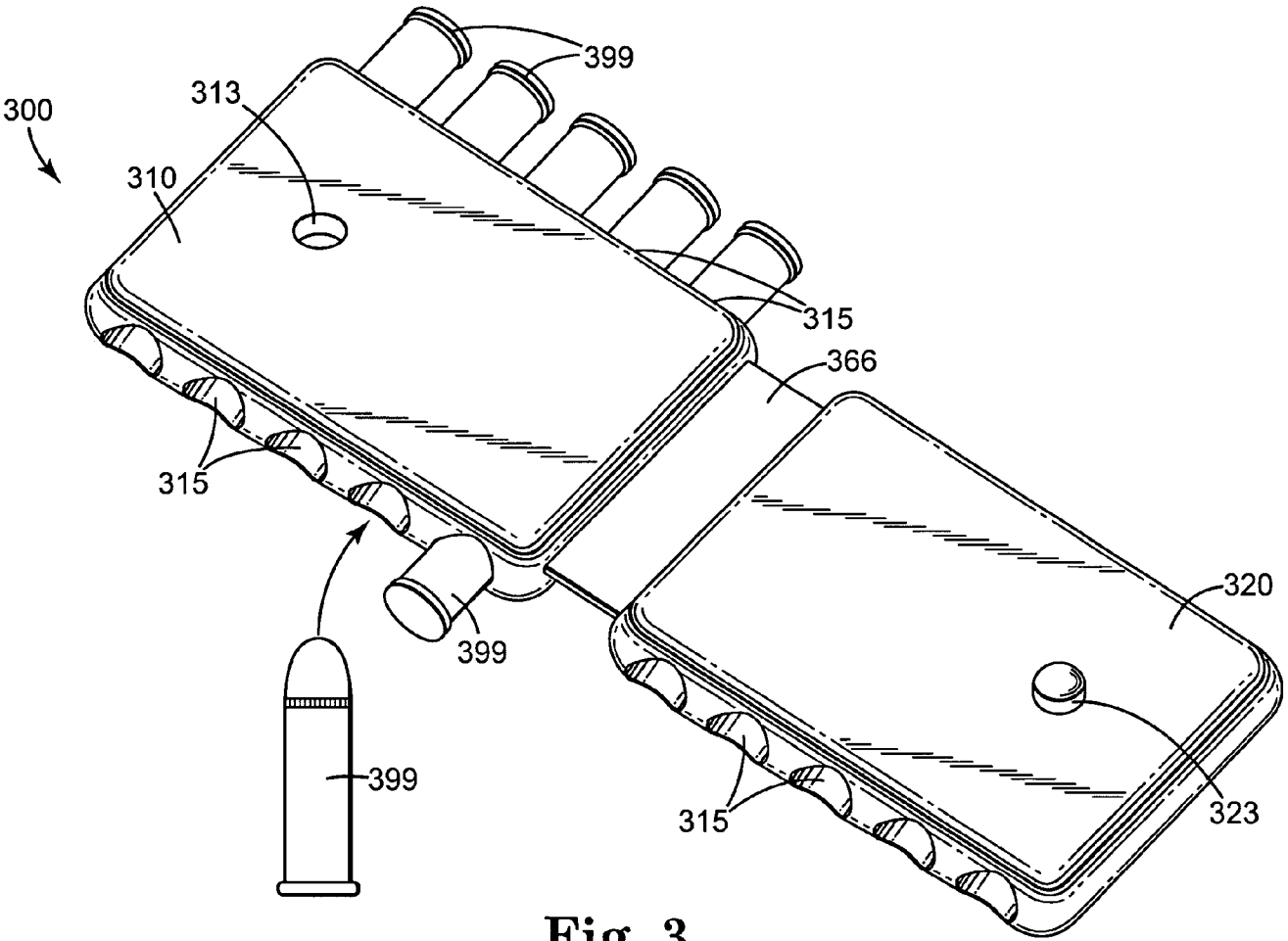
FIG. 3 illustrates an open view of a folding body member of an ammunition carrier system having several rifle cartridges disposed therein according to an embodiment of the present invention.

FIG. 3 is an open view of a foldable combination body member of an ammunition carrier system 300 having several pre-assembled rifle cartridges 399 disposed therein according to an embodiment of the present invention. In FIG. 3, the ammunition carrier system 300 is provided with a first body member 310 and a second body member 320. The first and second body members 310, 320 are flexibly connected together with attachment band 366. The flexible attachment band 366 extends along a substantial length of the first and second body members 310, 320. The flexible attachment band 366 permits the first and second body members 310, 320 to be folded over against each other and connected together for attachment around a belt of a hunter or shooter for hands free carrying of the ammunition carrier system (see FIGS. 4 and 5). The first and second body members 310, 320 are also connectable to each other via a connection means including a male plug 323 which is received into a female orifice 313 when the first and second body members 310, 320 are folded against each other. The male plug 323 and female orifice 313 may be formed integral with the first and second body members 310, 320 during a molding process. Although the male plug 323 and female orifice 313 connection is shown, numerous other connection means are envisioned such as snaps, magnets, hook and loop fasteners, cord ties and various other connection means. The first and second body members 310 and 320 are provided with a plurality of openings 315 along opposing ends thereof. The openings 315 may extend into the first and second body members 310, 320 a small portion of the width of the first and second body members 310, 320 or may extend through the entire width of the first and second body members 310, 320. The openings 315 are adapted to receive and frictionally retain rifle cartridges 399 therein. The openings 315 may also be adapted to receive and frictionally retain individual shooting accessories or container tubes.

The first and second body members 310, 320 may be molded from a resilient, flexible elastomeric material, such as natural rubber, latex rubber or silicone rubber. Such materials are durable and readily accept a variety of pigments, camouflage, and other surface ornamentation to accentuate consumer appeal. These materials accommodate the normally intended outdoor environment and also allow the tube receiving openings. The ammunition carrier system 300 disclosed in FIG. 3 provides a hunter or shooter with the capability of carrying a plurality of pre-assembled rifle cartridges 399 or shooting accessories.

Figure 4:
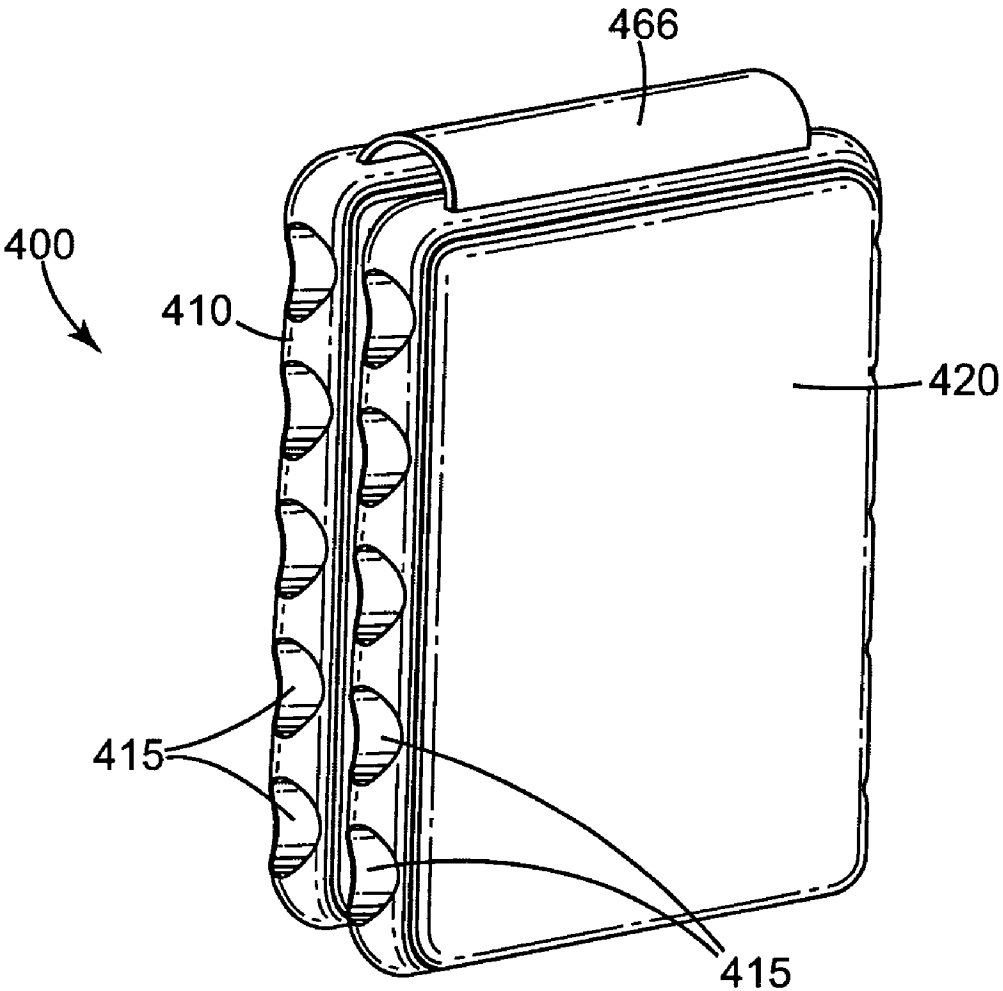
FIG. 4 illustrates a folded view of the folding body member with cartridge receiving openings exposed with all the rifle cartridges removed therefrom according to an embodiment of the present invention.

FIG. 4 is a folded view of the foldable combination body member of an ammunition carrier system 400 with cartridge receiving openings exposed with all the rifle cartridges removed therefrom according to an embodiment of the present invention. In FIG. 4, the ammunition carrier system 400 is shown in a folded configuration such that the first body member 410 and the second body member 420 are flexibly connected together by attachment band 466. In FIG. 4, the flexible attachment band 466 in combination with connection means (not shown) retain the first and second body members 410, 420 folded over against each other and connected together for attachment around a belt of a hunter or shooter for hands free carrying of the ammunition carrier system (see FIG. 5). The first and second body members 410 and 420 are provided with a plurality of openings 415 along opposing ends thereof. The openings 415 may extend into the first and second body members 410, 420 a small portion of the width of the first and second body members 410, 420 or may extend through the entire width of the first and second body members 410, 420. The openings 415 are adapted to receive and frictionally retain rifle cartridges, individual shooting accessories, and/or container tubes.

Figure 5:
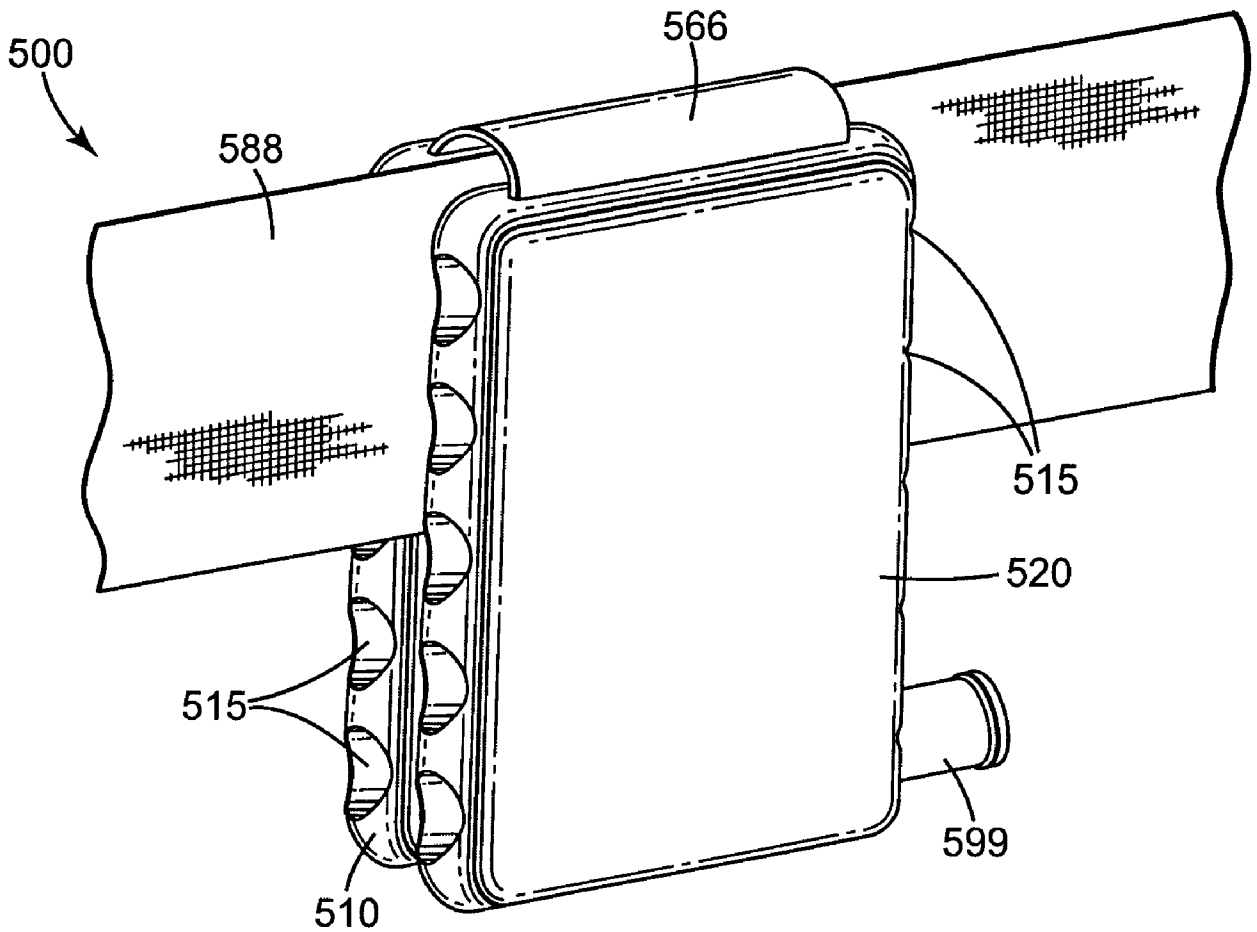
FIG. 5 illustrates a view of the folding body member of the ammunition carrier system folded over and mounted on a belt according to an embodiment of the present invention.

FIG. 5 is a view of the folding body member of the ammunition carrier system 500 folded over and mounted on a belt 588 according to an embodiment of the present invention. In FIG. 5, the ammunition carrier system 500 is shown in a folded configuration and attached to a belt 588 such that the first body member 510 and the second body member 520 are flexibly connected together. The flexible attachment band 566 in combination with connection means (not shown) retain the first and second body members 510, 520 folded over and connected together for attachment around the belt 588 of a hunter or shooter for hands free carrying of the ammunition carrier system. The flexible attachment band 566 extends along a substantial length of both the first and second body members. The first and second body members 510 and 520 are provided with a plurality of openings 515 along opposing ends thereof. The openings 515 may extend into the first and second body members 510, 520 a small portion of the width of the first and second body members 510, 520 or may extend through the entire width of the first and second body members 510, 520. The opening 515 is shown receiving and frictionally retaining a rifle cartridge 599 therein. The openings may be larger on one side of the first and second body members than the other or the first and second body members may have different sized openings depending upon the hunter or shooters needs.

Figure 6:
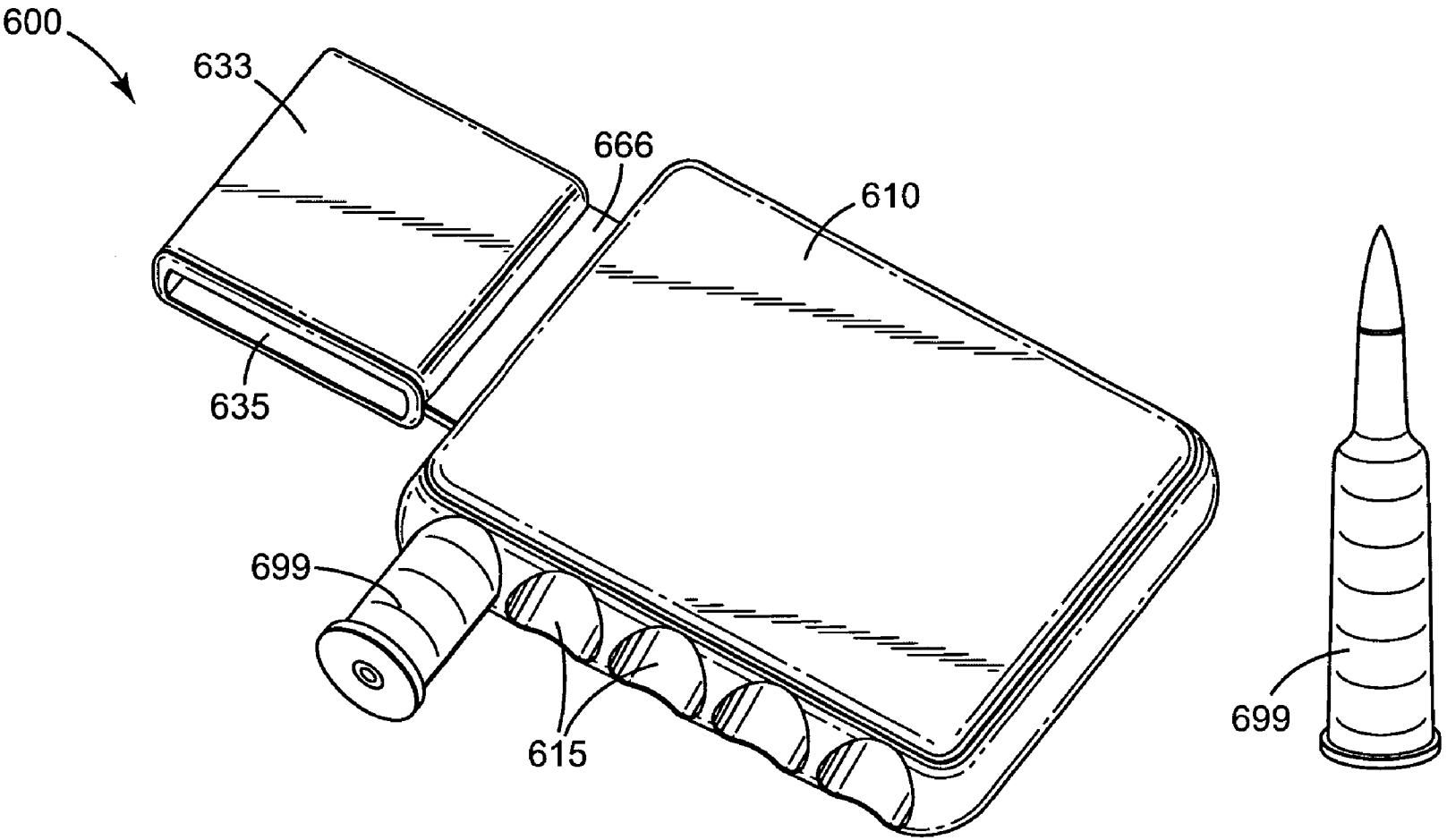
FIG. 6 illustrates a perspective view of an ammunition carrier system having an extending appendage forming a belt loop a distance away from the body member in another embodiment of the present invention.

FIG. 6 is a perspective view of an ammunition carrier system having an extending appendage forming a belt loop a distance away from the body member in another embodiment of the present invention. In FIG. 6, the ammunition carrier system 600 is shown provided with an extending appendage which may be a flexible attachment band 666 for flexibly connecting the body member 610 and the loop member 633. In FIG. 6, the flexible attachment band 666 retains and connects the body member 610 through loop opening 635 to a belt of a hunter or shooter for hands free carrying of the ammunition carrier system (see FIG. 7). The body member 610 is provided with a plurality of openings 615. The openings 615 may be along one end or along opposing ends of the body member 610. The openings 615 may extend into the body member 610 a small portion of the width of the body member 610 or may extend through the entire width of the body member 610. The openings 615 are adapted to receive and frictionally retain rifle cartridges 699, individual shooting accessories, and/or container tubes.

Figure 7:
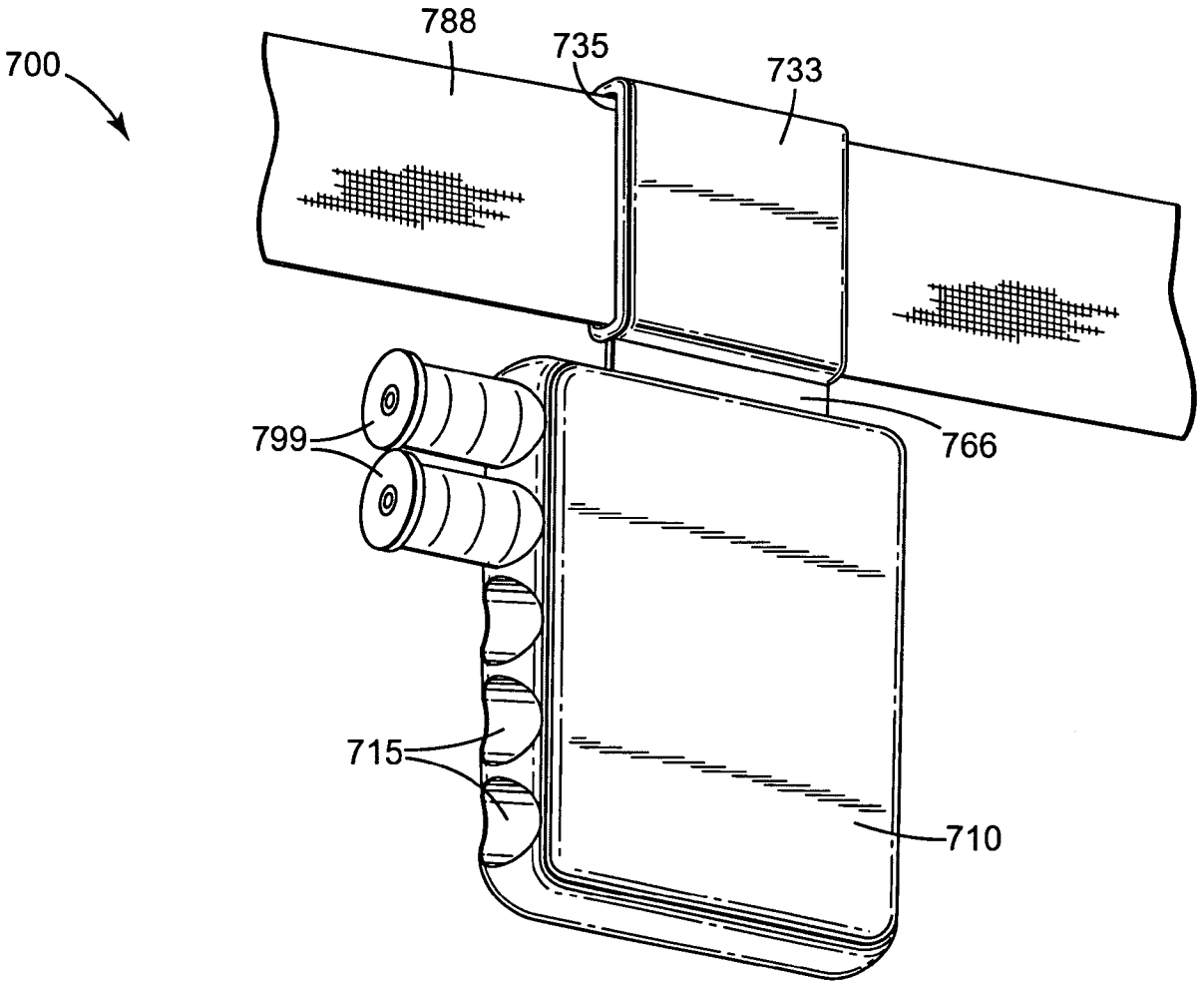
FIG. 7 illustrates a view of the ammunition carrier system having an extending appendage forming a belt loop disposed on a belt in another embodiment of the present invention.

FIG. 7 is a view of the ammunition carrier system having an extending appendage forming a loop member disposed on a belt in another embodiment of the present invention. In FIG. 7, the ammunition carrier system 700 is shown attached to a belt 788 such that the body member 710 hangs below the belt 788 from the flexible attachment band 766. The flexible attachment band 766 in combination with loop member 733 retains the body member 710 and connected for attachment to the belt 788 of a hunter or shooter for hands free carrying of the ammunition carrier system. The body member 710 is provided with a plurality of openings 715 along one end or opposing ends thereof. The openings 715 may extend into the body member 710 a small portion of the width of the body member 710 or may extend through the entire width of the body member 710. The openings 715 are shown receiving and frictionally retaining rifle cartridges 799 therein.

The foregoing objects, advantages and distinctions of the invention, among others, are obtained in a presently preferred construction that provides an elastomer ammunition carrier system provided with at least one body member having a plurality of openings to receive and frictionally retain open-ended storage container tubes, rifle cartridges and various other shooting accessories.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather by the claims appended hereto.

What is claimed is:

1. A carrier system comprising:

a plurality of container tubes, each container tube having an open end and a closed end and therefore being capable of holding items;

a body member having a plurality of first receiving recesses aligned substantially in parallel and each having a central axis and a ridge member disposed along a portion of the body member and extending substantially parallel with said central axes, the ridge member provided with plurality of openings wherein the recesses are adapted to receive and frictionally retain the container tubes therein, each container tube encloses a storage space and a portion of each container tube extends a distance from the body member when secured thereto, the storage space being accessible when the tube is unsecured from the body member.

2. The carrier system of claim 1, wherein the container tubes are removably securable to the body member via a frictional attachment between exterior surfaces of the tubes and interior surfaces of the recesses.

3. The carrier system of claim 1, wherein the container tubes provide watertight storage of accessories stored therein.

4. The carrier system of claim 1, wherein the recesses have a first diameter, the second openings have a second diameter, and the first diameter is different from the second diameter.

5. The carrier system of claim 1, wherein the ridge member extends substantially along a length of the body member.

6. The carrier system of claim 1, wherein the openings are adapted to receive and frictionally retain an accessory therein.

7. The carrier system of claim 1, further comprising a lanyard, the lanyard for securing the carrier system to a user, and the lanyard being connectable to an attachment opening disposed in the ridge member.

8. The carrier system of claim 1, wherein the body member and the ridge member are molded from a flexible elastomeric material, and wherein the recesses and openings are expandable to receive and frictionally retain therein accessories, wherein when the accessories are removed, the recesses and openings return to a pre-expansion dimension.

9. A carrier system comprising:

a plurality of container tubes, each container tube having an open end and a closed end;

a body member having a plurality of first openings; and a ridge member disposed along a portion of the body member, the ridge member provided with plurality of second openings arranged substantially perpendicular to the first openings, wherein the first openings are adapted to receive and frictionally retain the container tubes therein, each container tube encloses a storage space and a portion of each container tube extends a distance from the body member when secured thereto, the storage space being accessible when the tube is unsecured from the body member.

10. A carrier system comprising:

a plurality of container tubes, each container tube having an open end and a closed end and therefore being capable of holding items;

a body member having a plurality of recesses; and a ridge member disposed along a portion of the body member and extending substantially outwardly from said body, the ridge member provided with plurality of openings wherein the openings are adapted to receive and frictionally retain a plurality of items sized at least slightly larger than the openings;

each container tube enclosing a storage space and a portion of each container tube extending a distance from the body member when secured thereto, the storage space being accessible when the tube is unsecured from the body member.

* * * * *